US005113932A

United States Patent [19]

Sakaya et al.

[11] Patent Number: 5,113,932

[45] Date of Patent: May 19, 1992

[54] HEAT PIPE AND METHOD OF MANUFACTURING THE SAME

[75] Inventors: Masuji Sakaya, Narashino; Ryuichi Okiai, Yotsukaido; Masataka Mochizuki, Nagareyama; Kouichi Mashiko, Tokyo, all of Japan

[73] Assignee: Fujikura Ltd., Tokyo, Japan

[21] Appl. No.: 523,046

[22] Filed: May 14, 1990

Related U.S. Application Data

[62] Division of Ser. No. 365,531, Jun. 13, 1989, Pat. No. 4,953,632, which is a division of Ser. No. 282,025, Dec. 7, 1988, abandoned.

[30] Foreign Application Priority Data

| | | | |
|---|---|---|---|
| Dec. 9, 1987 | [JP] | Japan | 62-309669 |
| Apr. 27, 1988 | [JP] | Japan | 63-102422 |
| Apr. 27, 1988 | [JP] | Japan | 63-102423 |
| Apr. 27, 1988 | [JP] | Japan | 63-102424 |

[51] Int. Cl.[5] ..... F28D 15/02

[52] U.S. Cl. ..... 165/104.26; 165/181; 165/184; 29/890.032

[58] Field of Search ..... 165/104.26, 104.14, 165/177, 179, 184, 181; 29/890.032

[56] References Cited

U.S. PATENT DOCUMENTS

| | | | |
|---|---|---|---|
| 1,632,784 | 6/1927 | Blair | 165/177 |
| 2,977,914 | 4/1961 | Gray et al. . | |
| 3,921,710 | 11/1975 | Katayama . | |
| 4,109,709 | 8/1978 | Honda et al. . | |
| 4,283,824 | 8/1981 | Schatz et al. . | |
| 4,660,754 | 4/1987 | Byrd . | |
| 4,724,596 | 2/1988 | Pavlyak . | |
| 4,793,384 | 12/1988 | Lalibos et al. | 138/121 |

FOREIGN PATENT DOCUMENTS

| | | | |
|---|---|---|---|
| 0008456 | 3/1980 | European Pat. Off. . | |
| 2833787 | 2/1980 | Fed. Rep. of Germany | 165/104.14 |
| 48-12537 | 2/1973 | Japan . | |
| 50-27754 | 3/1975 | Japan . | |
| 51-18967 | 2/1976 | Japan . | |
| 53-4755 | 1/1978 | Japan . | |
| 165895 | 12/1981 | Japan | 165/104.14 |
| 10091 | 1/1982 | Japan . | |
| 409933 | 5/1934 | United Kingdom . | |

OTHER PUBLICATIONS

Patent Abstracts of Japan, vol. 10, No. 191 (M-495)(2247), Jul. 4, 1986 & JP-A-61 36 692 (Japan Goatetsukusu K.K.), Feb. 21, 1986.

Patent Abstracts of Japan, vol. 10, No. 155 (M-485)(2211), Jun. 4, 1986 & JP-A-61 8594 (Fujikura Densen K.K.), Jan. 16, 1986.

Patent Abstract of Japan, vol. 4, No. 176 (M-45)(658), Dec. 5, 1980; & JP-A-55 123 987 (Nippon Tokushu Togyo K.K.), Sep. 24, 1980.

Patent Abstracts of Japan, vol. 6. No. 71 (M-126)(949), May 6, 1982 & JP-A-57 10 091 (Fujikura Densen K.K.), Jan. 19, 1982.

Patent Abstracts of Japan, vol. 3, No. 97 (M-69), Aug. 17, 1979, pp. 137 69; & JP-A-54 73 349 (Sumitomo Denki Kogyo K.K.), Jun. 12, 1979.

Patent Abstracts of Japan, vol. 7, No. 85 (M-206)(1230), Apr. 9, 1983; & JP-A-58 11 387 (Fujikura Densen K.K.), Jan. 22, 1983.

Patent Abstract of Japan & JP 58-11388 (Fujikura Densen K.K.), Jan. 22, 1983.

*Primary Examiner*—Albert W. Davis, Jr.

*Attorney, Agent, or Firm*—Frishauf, Holtz, Goodman & Woodward

[57] ABSTRACT

A wick layer is attached and fixed to one surface of a metal tape without forming a gap with the metal surface, and thereafter, the tape is rolled so that the surface having the wick layer serves as an inner surface, thus forming a pipe shape, then the pipe wall is corrugated. According to the above process, the wick layer is completely and uniformly attached to the inner surface of the heat pipe.

2 Claims, 4 Drawing Sheets

HEAT PIPE AND METHOD OF MANUFACTURING THE SAME

This is a division of application Ser. No. 07/365,531 filed Jun. 13, 1989, now U.S. Pat. No. 4,953,632, granted Sep. 4, 1990 which is a division of Ser. No. 07/282,025 filed Dec. 7, 1988 abandoned.

BACKGROUND OF THE INVENTION

1. Field of the Invention

The present invention relates to a heat pipe used for heat conduction and a method and apparatus for manufacturing an elemental or original pipe of the heat pipe.

2. Description of the Related Art

Conventionally, in order to manufacture a heat pipe, a wick such as a metal gauze is attached through an open end portion from the outside to an inner wall of an elemental heat pipe formed into a hollow shape.

However, this method is cumbersome; it is difficult to uniformly attach the wick to he entire inner wall surface; it is not easy to check whether or not the wick is correctly attached; it is difficult to attach a wick to the inner wall of a corrugated pipe due to its corrugated surface shape, which results in deterioration of heat characteristics; and more specifically, as shown in FIG. 1, gap K is present between diameter D of inner crest portion and diameter d of inner root portion, thus causing deterioration of the heat characteristics. (in FIG. 1, a cross-hatched portion indicates a wick).

In this invention, a wick layer is attached and fixed to one surface of a metal tape without forming a gap with the metal surface, and thereafter, the tape is rolled so that the surface having the wick layer serves as an inner surface, thus forming a pipe shape, then the pipe wall is corrugated.

SUMMARY OF THE INVENTION

The present invention has been made in consideration of the above situation, and has as its object to provide a heat pipe, to an inner surface of which a wick is completely and uniformly attached, and a method of manufacturing the same using a simple process.

According to the present invention, there is provided a method of manufacturing a heat pipe, comprising the steps of:

feeding a tape from a tape roll;

forming a wick layer on one surface of the fed tape; and forming the tape having the wick layer thereon into a pipe shape.

According to the present invention, there is further provided a method of manufacturing a heat pipe, comprising the steps of:

feeding a tape from a tape roll;

forming a wick layer on one surface of the fed tape;

forming the tape having the wick layer thereon into a pipe shape; and forming a groove-like or wave-like pattern on a necessary portion of an outer surface of the heat pipe which is formed into the pipe shape.

According to the present invention, there is still further provided a heat pipe comprising a pipe prepared by welding a mating edge of a metal tape, and a wick layer formed on an inner surface of said pipe, wherein Q-shaped grooves in which a length of a wave of an outer projecting portion is larger than that of an inner recessed portion, is formed on an outer surface of the pipe in a radial or oblique direction thereof.

According to the present invention, there is yet further provided a heat pipe comprising a pipe prepared by welding a mating edge of a metal tape, and a wick layer formed on an inner surface of said pipe, wherein groove-formed portions are formed in an axial or oblique direction at equal intervals on an outer surface of the pipe.

According to the present invention, there is further provided a method of manufacturing a heat pipe, comprising the steps of:

forming a wick layer on one surface of a fed tape;

forming the tape on which the wick layer is formed into a pipe shape and bonding mating edges of the tape by welding or adhesion to perform the tape into a pipe, thus preparing a first-phase heat pipe; and forming groove-formed portions in an axial or oblique direction at equal intervals on an outer surface of the heat pipe which is formed into the pipe shape.

According to the present invention, there is still further provided a heat pipe comprising a pipe prepared by welding a mating edge of a metal tape, and a wick layer formed on an inner surface of said pipe, wherein wavy small ridges or recesses are formed on an outer surface of the pipe in a radial or oblique direction at predetermined intervals.

According to the present invention, there is further provided a method of manufacturing a heat pipe, comprising the steps of:

feeding a tape from a tape roll;

forming a wick layer on one surface of the fed tape;

forming the tape having the wick layer thereon into a pipe shape; and forming a groove-like pattern on a predetermined portion of an outer surface of the heat pipe formed into the pipe shape, while transferring the heat pipe.

According to the present invention, there is yet further provided a method of manufacturing a heat pipe, comprising the steps of:

feeding a tape from a tape roll;

forming a wick layer on one surface of the fed tape;

forming the tape having the wick layer thereon into a pipe shaped; and intermittently transferring the heat pipe formed into the pipe shape and forming, when the pipe is stopped, a groove-like pattern on an outer surface of the pipe.

According to the present invention, there is still further provided a method of manufacturing a heat pipe, comprising the steps of:

feeding a tape from a tap roll;

forming a wick layer on one surface of the fed tape;

forming the tape having the wick layer thereon into a pipe shape;

forming a groove-like pattern on a predetermined portion of an outer surface of the heat pipe formed into the pipe shape, while transferring the heat pipe; and intermittently transferring the heat pipe formed into the pipe shape and forming, when the pipe is stopped, a groove-like pattern on the outer surface of the heat pipe.

DETAILED DESCRIPTION OF THE PREFERRED EMBODIMENTS

Figure 1:
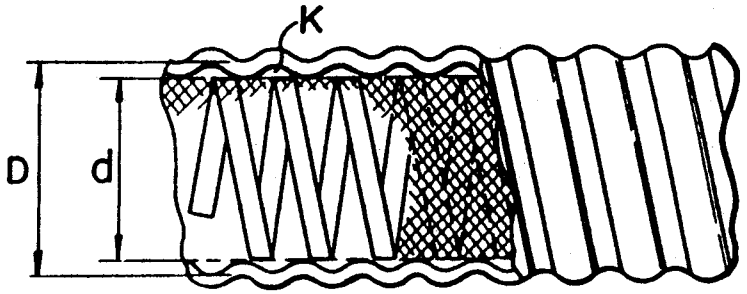
FIG. 1 shows a conventional corrugated heat pipe.
Figure 2:
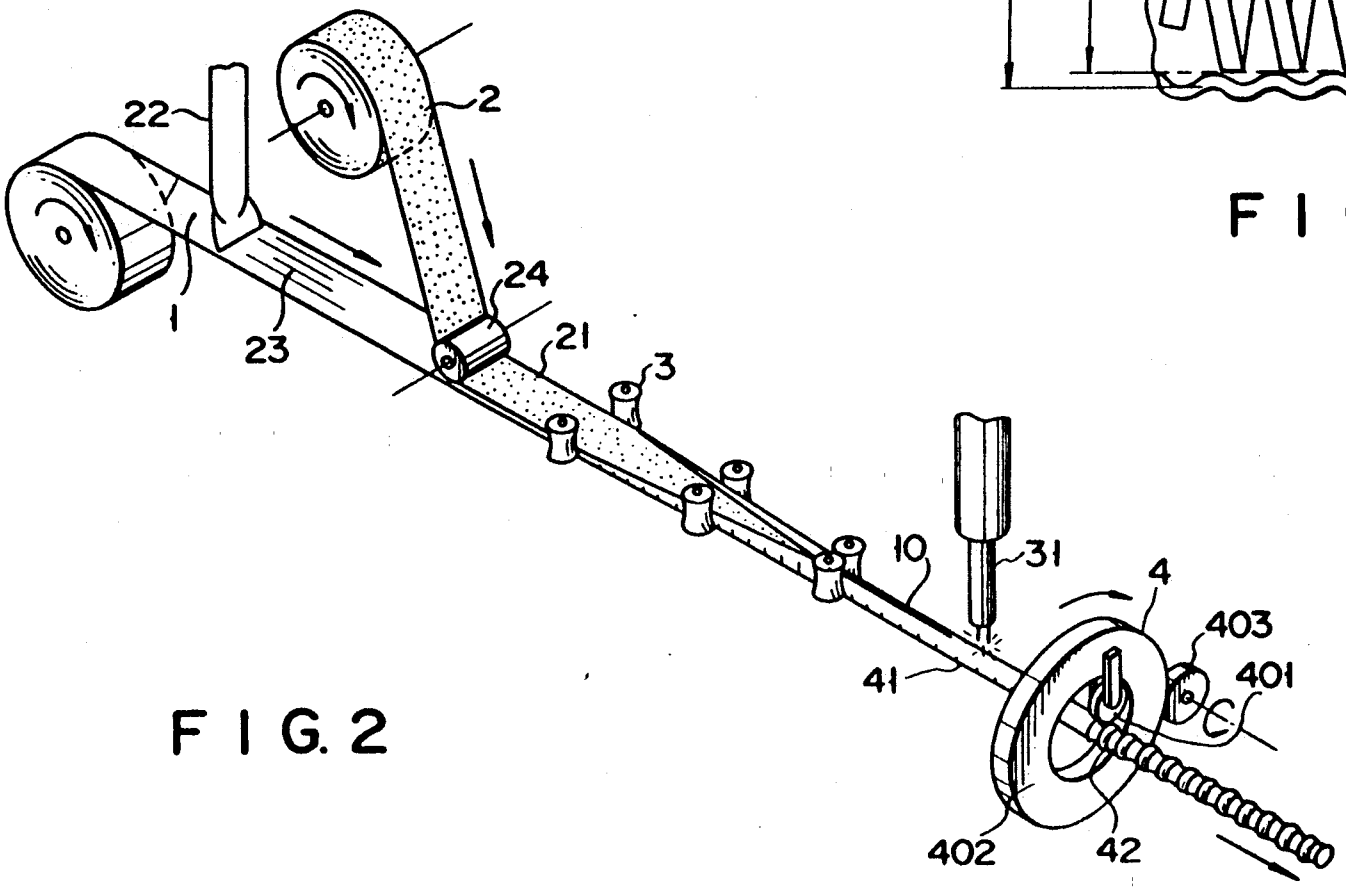
FIG. 2 shows an apparatus used for manufacturing a heat pipe according to an embodiment of the present invention.

An embodiment of the present invention will now be described with reference to FIG. 2.

Reference numeral 1 denotes a metal tape which is wound in a roll shape in a conventional feeding apparatus (not shown) and is therefrom. Metal tape 1 is formed into a heat pipe as a final product. Metal tape 1 is made of copper, aluminum, iron, or stainless steel, and has a width of 30 to 450 mm, and a thickness of 0.2 to 2.0 mm.

Reference numeral 2 denotes a wick member comprising a tape to which a fibrous wick material is adhered. Wick member 2 is brought into close contact with and attached to one surface of metal tape 1 to form wick layer 21. Wick layer 21 has a capillary action, and the wick material includes an organic or inorganic metal fiber, glass fiber, animal/vegetable fiber, synthetic resin fiber, or the like. Wick layer 21 may be prepared by disposing the fibrous wick material on the tape. Wick layer 21 may also be prepared by forming the above-mentioned fiber into a net, nonwoven fabric, or porous material.

In order to attach wick member 2 to one surface of metal tape 1, wick member 2 is wound into a roll shape in a feeding apparatus (not shown) in the same manner as in metal tape 1, and is fed therefrom at the same speed as the feeding speed of metal tape 1 to be brought into tight contact with and adhered to one surface of metal tape 1.

In order to adhere wick member 2 to tape 1, adhesive 23 is sprayed and applied from nozzle 22 onto the surface of metal tape 1. When wick member 2 is attached, press roller 24 is preferably used.

Reference numeral 3 denotes forming rollers, each of which forms metal tape 1, after being subjected to the above-mentioned process, into a pipe shape, so that wick layer 21 serves as an inner surface. Each forming roller 3 has an arcuated shape in order to form metal tape 1 into a pipe shape.

A plurality of pairs of opposing forming rollers 3 are arranged along the moving direction of metal tape 1. Each of the rollers 3 has an arc configuration and is vertically rotatable around the axis. However, the roller 3 can be arranged in other forms, for example, in a staggered form. The arcs of the pairs of forming rollers 3 can be the same, but are preferably changed in accordance with the progress of metal tape 1 in the pipe forming process.

For example, the first stage of forming rollers 3 may have a large radius of curvature, and the radius is gradually decreased to a size corresponding to a pipe diameter as the process progresses. Rollers 3 may have a shape other than the above-mentioned shape, and may be axially supported in a direction other than in the vertical direction.

Reference numeral 31 denotes a welding means for welding the mating edges 10 at the start of the formation of heat pipe 41. A welding electrode of welding means 31 is arranged immediately above mating edges 10 to weld mating edges 10. Note that a process for cooling the pipe immediately after welding may be added so as not to damage already attached wick layer 21.

The pipe obtained after the above process can be used as a finished product, or can further be corrugated.

Reference numeral 4 denotes a corrugating machine for forming a groove-like or wave-like pattern. The pattern provides a flexibility on the outer surface of the heat pipe 41 and holds the working fluid in the heat pipe. More specifically, corrugating machine 4 comprises small disc 401 which is rotatably pressed along outer surface 42 of heat pipe 41, and ring 402 which holds the disc therein and is rotated along outer surface 42 of heat pipe 41. Ring 402 is rotated by rotating disc 403 arranged thereon.

Small disc 401 has a rounded outer shape. In this case, when ring 402 is rotated, small disc 401 is also rotated while pressing elemental heat pipe 41, thus forming a smooth helically corrugated pattern on the outer surface of elemental heat pipe 41 at a constant pitch.

When small disc 401 has a flat outer shape, a groove-like or wave-like pattern can be formed.

If a groove-like or wave-like pattern is formed by corrugating machine 4 while moving heat pipe 41 is temporarily stopped, a wavy or groove-like pattern extending in the circumferential direction can be obtained on the outer surface of heat pipe 41.

If pressing of small disc 401 is stopped with respect to elemental heat pipe 41, neither wavy nor groove-like pattern can be formed. If pressing is intermittently performed, a wavy or groove-like pattern can be intermittently formed on the outer surface of elemental pipe 41. More specifically, a wavy or groove-like pattern can be formed on an arbitrary portion of the outer surface of pipe 41, as needed.

Mode of transferring the elemental pipe can be modified as desired. That is, the elemental pipe may be continuously, regularly, or irregularly transferred. Furthermore, the groove forming means can be transferred in correspondence to the transfer of the elemental pipe.

The pipe formed as described above can be subjected to normal processes, e.g., cutting of the heat pipe, injection of working fluid, sealing of both ends, and the like, thus completing the heat pipe.

Figure 3:
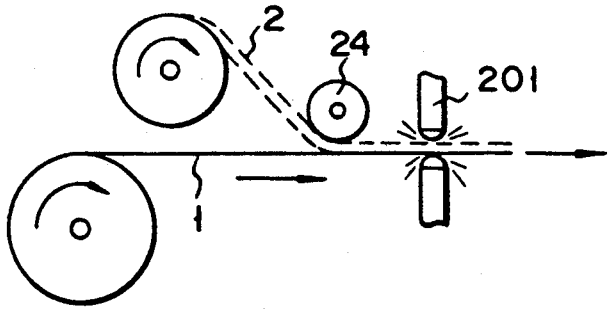
FIGS. 3 to 5 show structures used for forming an wick layer on a metal tape.
Figure 4:
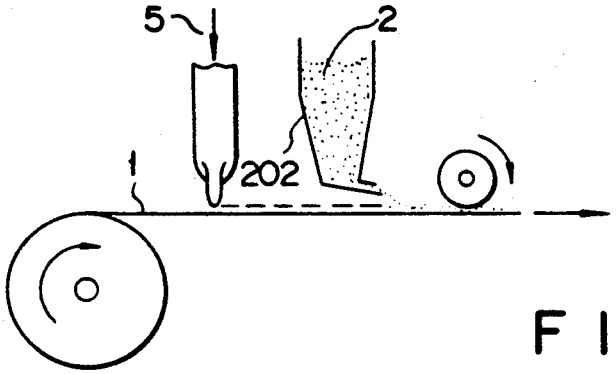
Figure 5:
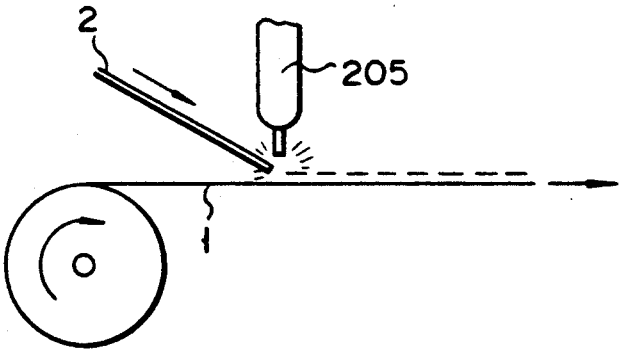

FIGS. 3 to 5 show other embodiments wherein wick layer 21 is formed on metal tape 1.

FIG. 3 shows an embodiment wherein wick member 2 is made of a metal, e.g., a metal gauze. In this embodiment, wick member 2 is preformed into a tape-like shape, is fed from a state wherein it has been rolled, and is overlaid on moving metal tape 1.

Spot welding electrodes 201 are arranged at both sides of the moving path of metal tape 1, so that tape-like wick member 2 is attached and fixed to metal tape 1 by spot welding electrodes 201. In this case, wick member 2 is preferably pressed against metal tape 1 by rollers 24, as in the above embodiment. This applies to the following embodiments.

FIG. 4 shows an embodiment wherein wick member 2 is a powder, particles, or very fine fibers. In this embodiment, wick member 2 is accumulated in hopper 202. Wick member 2 can be any one of the powder, particle, or very fine fibers or may be a combination thereof.

Prior to attachment of wick member 2 to metal tape 1, an adhesive is applied to the surface of tape 1, e.g. a plastic tape, by nozzle 5. Wick member 2 is fed to the applied surface by, e.g., spraying from hopper 202, thus attaching and fixing wick member 2 on the surface of tape 1.

FIG. 5 shows an embodiment wherein wick member 2 comprises an organic or inorganic solid material. In this embodiment, solid wick member 2 is fused, brazed, or welded by nozzle 205 and the powder is attached and fixed to one surface of metal tape 1.

Figure 6:
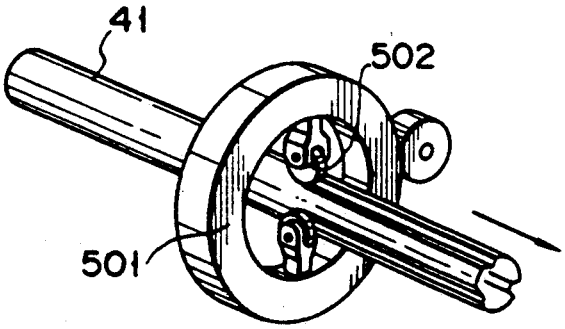
FIG. 6 shows a grooving machine for a groove-like pattern on a heat pipe.

FIG. 6 shows a grooving machine for forming a groove-like pattern on the surface of heat pipe 41 along its longitudinal direction. Grooving machine 501 has a hollow ring shape, and has an appropriate number of small discs 502 each having a groove forming function in its hollow portion toward the center.

If heat pipe 41 is moved while grooving machine 501 is not rotated, grooves can be formed along the longitudinal direction of elemental pipe 41. If grooving machine 501 is rotated in the lateral direction, helical grooves can be formed.

Figure 7:
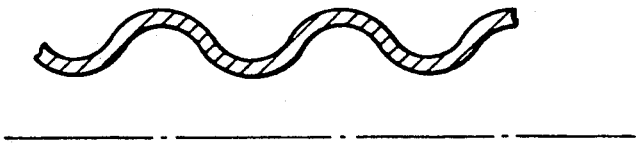
FIG. 7 shows a wave-like pattern formed on a heat pipe.
Figure 8A:
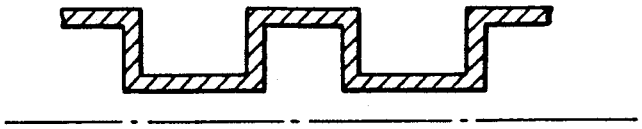
FIGS. 8A to 13 show groove-like patterns formed on a heat pipe.
Figure 8B:
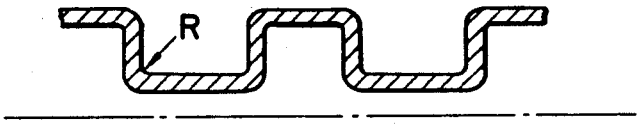
Figure 8C:
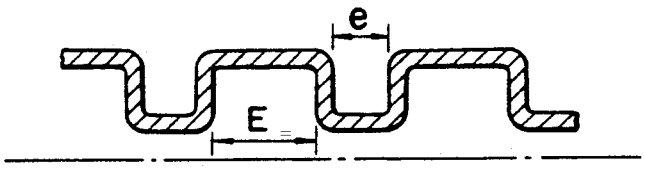
Figure 8D:
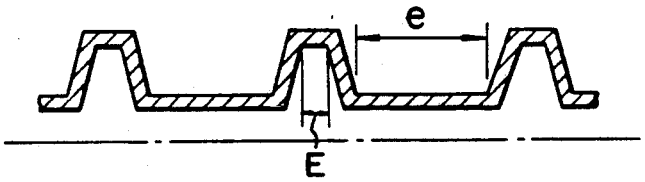
Figure 9:
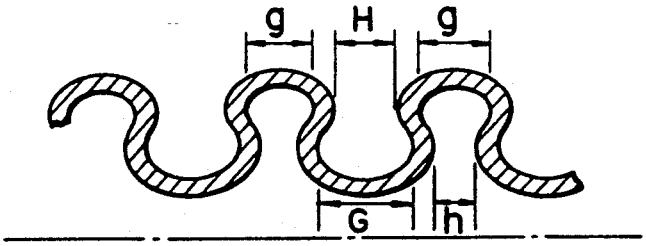

FIGS. 7 to 10 are longitudinal sectional views of groove-like or wave-like patterns formed on elemental pipe 41. FIG. 7 shows an embodiment of a smoothly formed wavy pattern, and FIGS. 8A to 8D show different embodiments of the groove-like pattern. FIG. 8A shows an embodiment wherein each corner of the bottom portion of the groove has no radius of curvature, and FIG. 8B shows an embodiment wherein each corner has radius R of curvature. FIGS. 8C and 8D show embodiments wherein width E of the crest portion is different from width e of the trough portion. In FIGS. 8A to 8C, each section extending from the crest portion to the trough portion has a vertical wall, but in FIG. 8D, each section has an inclined wall. FIG. 9 shows an embodiment of a wavy pattern having bulges on the crest and trough portions. Inner diameter g of the crest portion and inner diameter G of the trough portion are respectively larger than their open end gaps h and H. Note that inner diameters g and G of the crest and root portions may be or may not be equal to each other. The groove pattern shown in FIG. 9 has a high working fluid holding force.

According to the above embodiments, a wick layer can be uniformly and firmly attached and fixed to the entire inner wall of a heat pipe, thus improving the heat characteristics of the heat pipe.

More specifically, since a wick layer is formed on a metal tape before being formed into a pipe shape, the contact state of the wick layer is not influenced even if machining and deformation are performed thereafter.

Figure 10:
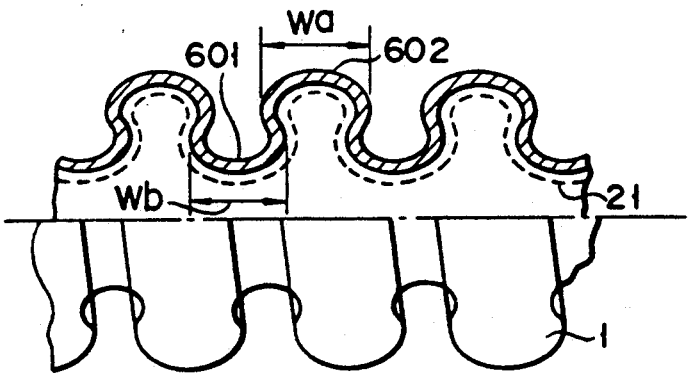

FIG. 10 shows yet another embodiment of the present invention. In this embodiment, an Q-shaped groove, in which the length of a wave of an outer projecting portion is larger than that of an inner recessed portion, is formed on the outer surface of a pipe in its radial or oblique direction.

More specifically, reference numerals 601 and 602 denote grooves comprises Ω-shaped ridges and recesses. When the widths of the ridge and recess are given by Wa and Wb, they are formed to establish $Wb < Wa$.

It is preferable that Wa is 1.01 to 5 times Wb, and more specifically, 1.1 to 2 times. These parameters are determined in consideration of an inner diameter, wall thickness, operation temperature, heat transfer amount, and the like, of the pipe.

In the pipe of this structure, a reinforcement effect can be provided against an external crushing force. Since ridge 602 has a hollow portion, a working fluid moving along the wall surface in the heat pipe can be sufficiently stored in the inner hollow portion, and heat from the outside of the pipe can be quickly conducted to the working fluid, thus improving heat efficiency.

The heat pipe is particularly suitable when the pipe is used in an uprightly set state. That is, it is particularly effective when the working fluid is uniformly distributed in an elongated heat absorbing portion of an elongated heat pipe used for absorbing terrestrial heat.

Figure 11:
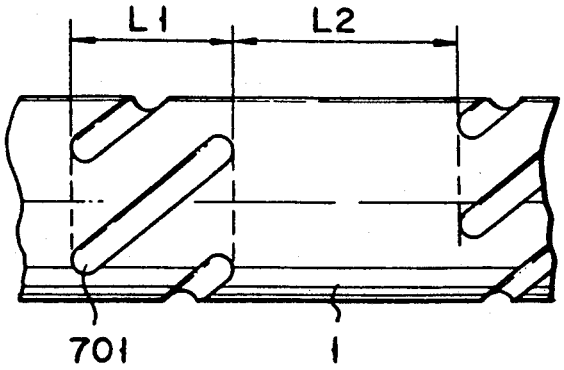

FIG. 11 shows still another embodiment of a groove-like pattern. In this embodiment, grooving is performed on the outer surface of heat pipe 41 in an axial direction or to be inclined at, e.g., 10° to 89° with respect to the axial direction. The grooving is performed every predetermined length of the starting pipe. Partial length $L_1$ corresponding to groove portion 701 formed on the outer surface of elemental heat pipe 41 and partial length $L_2$ corresponding to a groove non-forming portion alternately appear over the total length.

Length $L_1$ of the groove portion is designed to be an optimal value depending on the outer diameter, wall thickness, material, and the like, of heat pipe 1. However, length $L_1$ of the groove portion is determined so as not to extend the outer surface of elemental heat pipe 1. Length $L_2$ of the non-groove portion is determined to be substantially equal to or smaller than length $L_1$ of the groove portion. When a plurality of groove portions 701 is formed at the same time, the starting and end points may be or may not be aligned at positions perpendicular to the axial direction of heat pipe 1.

When a plurality of groove portions 701 is formed, about half of the groove portions 701 can be formed to extend clockwise around elemental heat pipe 1 and remaining groove portions 701 can be formed to extend counterclockwise around pipe 1. A plurality of grooves can be simultaneously formed to extend clockwise in a first step in the longitudinal (axial) direction of heat pipe 1, and can be simultaneously formed to extend counterclockwise in the next step.

Figure 12:
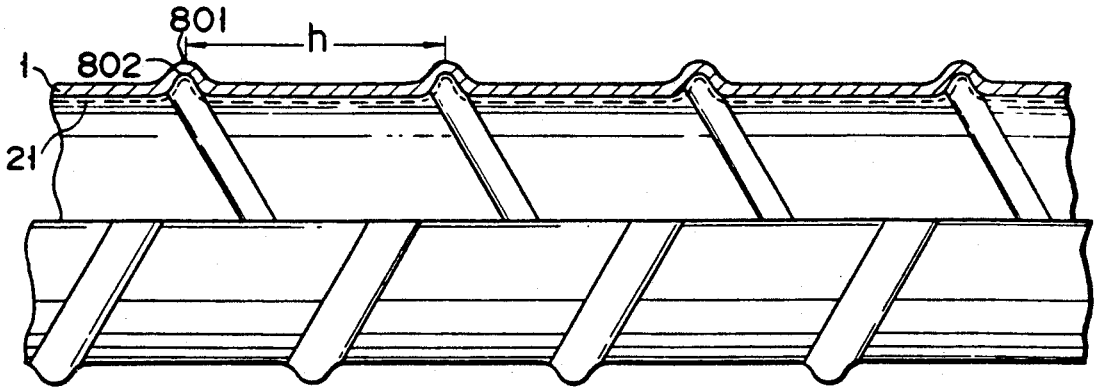

FIG. 12 shows still another embodiment. In this embodiment, reference numeral 801 denotes small wavy ridges, which are formed on the outer surface of pipe 1 in the radial or oblique direction at intervals h. Wick layer 21 is formed on the inner surface as small recess 802 of each small ridge 801. Interval h between two adjacent small ridges 801 is about four times or more the width of the small ridge.

Figure 13:
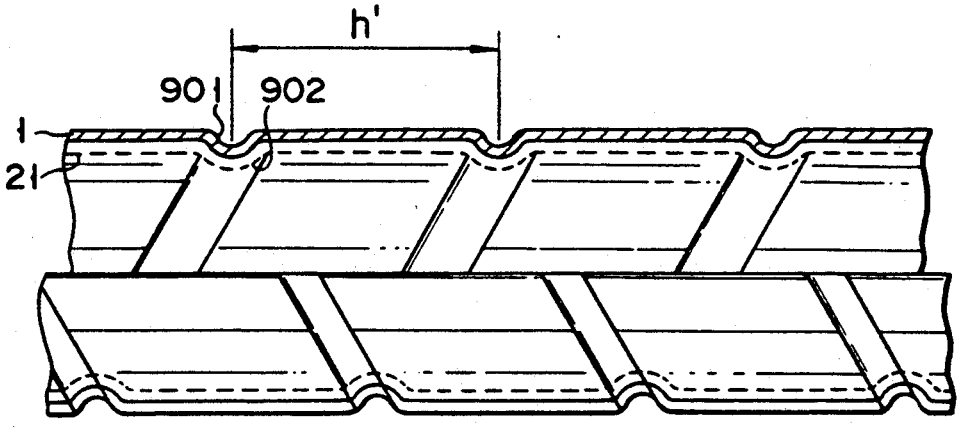

FIG. 13 shows a further embodiment. In this embodiment, small recess 901 is formed in place of the small ridge. Small recesses 901 are formed on the outer surface of pipe 1 also in the radial or oblique direction at intervals h'. Wick layer 21 is formed on the inner surface as small ridge 902 of each small recess 901. Interval h' between two adjacent small recesses 901 is about four times or more the width of the small recess.

In the pipe with the above-mentioned structure, wick layer 21 on the inner surface has small recesses 802 or small ridges 902 at proper intervals. The flow of working fluid flowing along the wall surface in the heat pipe can be temporarily and readily stored in the recesses or ridges, i.e., can be appropriately accumulated. In particular, it is effective for an upright use state of the heat pipe. In addition, it is particularly effective when working fluid is uniformly distributed in an elongated heat absorbing portion in an elongated heat pipe used for absorbing terrestrial heat. These ridges or recesses have a reinforcement effect against an external crushing force.

What is claimed is:

1. A heat pipe comprising:

a pipe having mating edges of a metal tape shaped in the form of a pipe;

a wick layer on an inner surface of said pipe; and rectangle-like projecting surface portions formed on at least an outer surface portion of said pipe in a predetermined direction, said rectangle-like projecting surface portions being integrally formed and comprising rectangle-shaped portions with rounded corners.

2. A heat pipe comprising:

a pipe having mating edges of a metal tape shaped in the form of a pipe;

a wick layer on an inner surface of said pipe; and rectangle-like projecting surface portions formed on at least an outer surface portion of said pipe in a predetermined direction, said rectangle-like projecting surface portions comprising rectangle-shaped portions having rounded corners, the width of a top side of each of the rectangle-like projecting surface portions being different from that of a bottom side thereof.

* * * * *